United States Patent [19]

Giangiulio et al.

[11] Patent Number: 4,464,109

[45] Date of Patent: Aug. 7, 1984

[54] CAPPED PLASTIC CONTAINER

[75] Inventors: Clayton Giangiulio; Dominic D'Ambro, both of Malvern, Pa.

[73] Assignee: Le-Jo Enterprises, Inc., Malvern, Pa.

[21] Appl. No.: 356,878

[22] Filed: Mar. 10, 1982

[51] Int. Cl.[3] ..... F23D 3/18; B65D 8/18

[52] U.S. Cl. ..... 431/344; 29/509; 220/67; 229/5.6; 413/5; 413/7

[58] Field of Search ..... 220/67, 66, 310; 229/5.6, 5.8; 215/352; 413/2, 4–7, 26, 27; 431/344; 29/509

[56] References Cited

U.S. PATENT DOCUMENTS

| | | | |
|---|---|---|---|
| 1,700,984 | 2/1929 | Hothersall | 413/2 |
| 1,954,737 | 4/1934 | Kowal | 413/2 X |
| 2,700,186 | 1/1955 | Stover | 215/352 X |
| 3,158,277 | 11/1964 | Luertzins | 215/327 |
| 3,224,627 | 12/1965 | Dielmann et al. | 220/310 |
| 3,307,728 | 3/1967 | Elser | 215/352 X |
| 3,313,440 | 4/1967 | Nofer | 220/67 |
| 3,491,936 | 1/1970 | Fox | 220/67 X |
| 3,774,560 | 11/1973 | Hartz | 220/67 X |
| 3,938,947 | 2/1976 | Rosenthal | 431/344 |
| 4,025,290 | 5/1977 | Giangiulio | 431/344 X |

FOREIGN PATENT DOCUMENTS

| | | | |
|---|---|---|---|
| 886244 | 8/1953 | Fed. Rep. of Germany | 220/310 |
| 96609 | 1/1961 | Netherlands | 229/5.6 |

*Primary Examiner*—Allan N. Shoap

*Attorney, Agent, or Firm*—Benasutti and Murray

[57] ABSTRACT

A disposable lamp comprising a body, formed of a plastic material for holding a flammable fluid therein and including a mouth onto which is secured a burner-closure assembly. The burner-closure assembly comprises a burner and cap means. The cap means is circular in profile and includes a rolled lip extending about the periphery and having a free edge. The lip includes an underside surface on which gasket means is located. The mouth of the bottle is tubular and includes a bead extending about the periphery of the free edge, which bead includes a pair of peripherally extending tapered edges. The cap is disposed over the mouth of the body with the bead located within the rolled lip and with the rolled lip bent tightly thereabout so that the tapered edges of the bead tightly engage the gasket means to form a fluid-tight seal between the cap means and the body.

17 Claims, 7 Drawing Figures

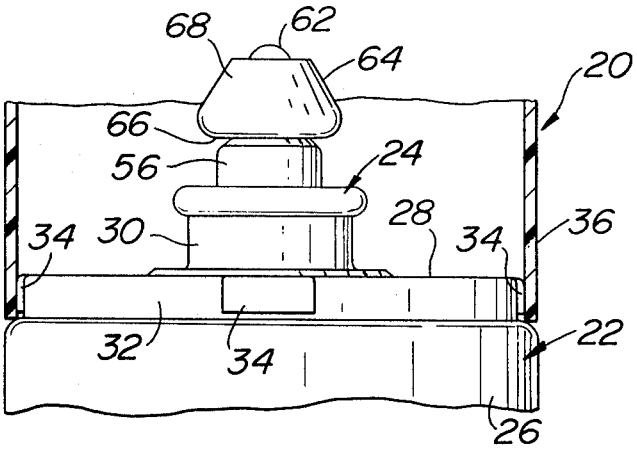
FIG. 1
FIG. 2
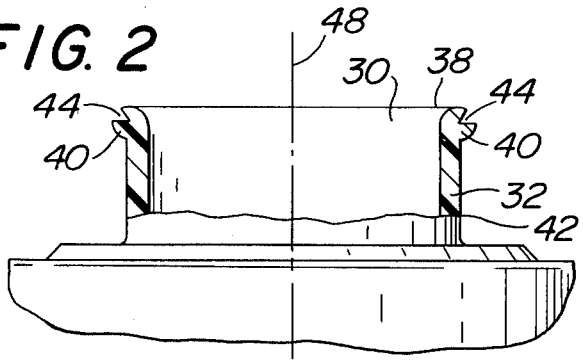
FIG. 3
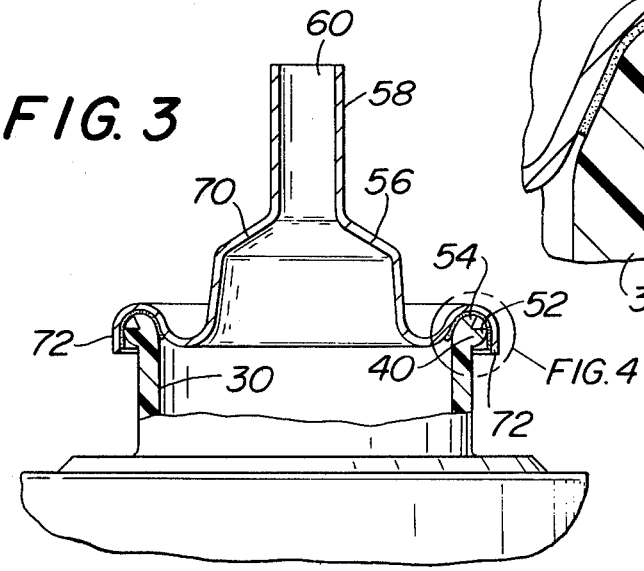
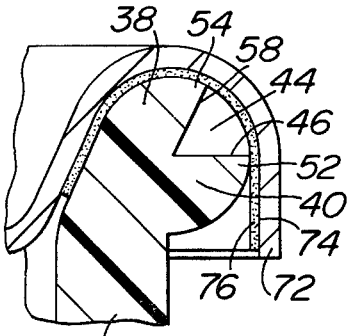
FIG. 4

FIG. 6
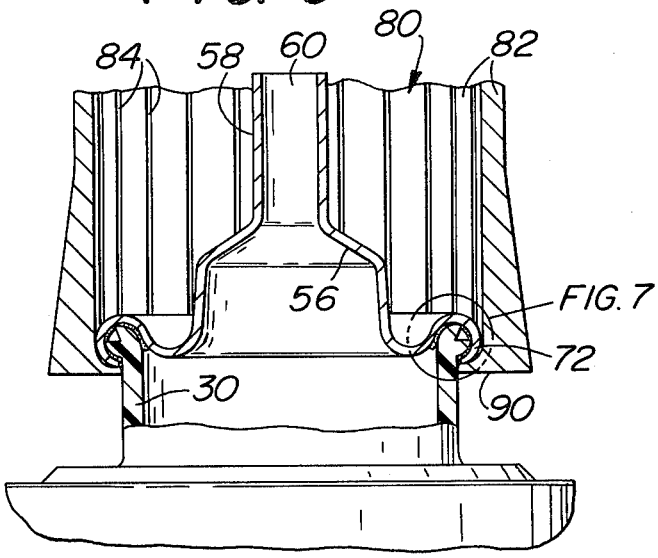
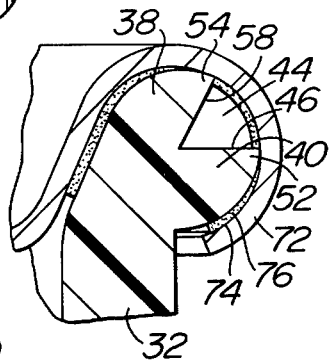
FIG. 7
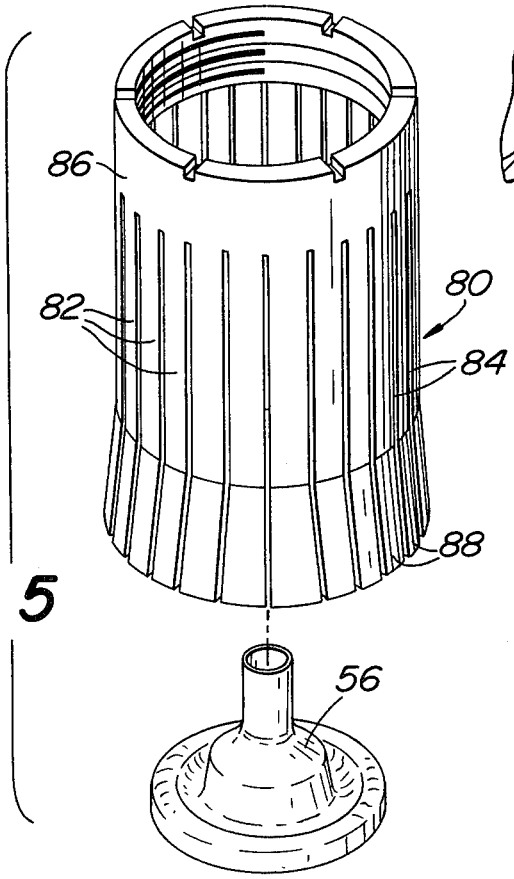
FIG. 5

CAPPED PLASTIC CONTAINER

BACKGROUND OF THE INVENTION

This application relates generally to lamps, and more particularly to replaceable, combustible fuel-burning lamps.

Combustible fuel-burning lamps are commercially available for providing decorative illumination on tables such as found in restaurants, nightclubs, etc. Heretofore, such lamps have consisted of a body or cannister acting as a reservoir for the lamp's fuel and a burner and/or wick assembly mounted at the top of the body.

For example, in my prior U.S. Pat. No. 4,025,290, whose disclosure is incorporated by reference herein, a decorative lamp comprising a housing including a recess and a self-contained and replaceable mineral spirit-burning lamp assembly disposed within the housing is disclosed and claimed. The assembly comprises a cannister of mineral spirits into which a wick extends. The cannister is in the form of a hollow, metallic body, shaped like a conventional aerosol container and serving as the reservoir for the lamp's mineral spirits fuel.

The top of the cannister includes a flanged lip which is rolled downward to form a mouth of the type commonly referred to as a "One-inch aerosol opening". The lamp's top assembly includes, among other things, a wick and an automatic snuffer. The top assembly is permanently secured to the cannister's mouth. That securement is accomplished by means of a hollow metal crown. The hollow crown is circular in profile and forms another portion of the top assembly. The free end of the crown is in the form of a downturned, U-shaped peripheral flange which receives the flange of the cannister's mouth and which is bent therearound to permanently secure the crown onto the cannister to form a fluid-tight seal therebetween.

The crown also includes a projecting tubular central portion. The tubular portion terminates in an open end. A cup-shaped cap member is snapped in place over the open end of the tubular portion and includes a pair of openings through which portions of the wick pass. In this regard, the wick is folded in two with the folded mid-portion extending outside the cap between the openings and with the free ends of the wick extending through the openings into the tubular portion and into the cannister for immersion in the mineral spirits therein. The portion of the wick projecting out of the cap member serves as the flame site. The cap also includes a pressure release port which is disposed adjacent the openings through which the wick extends and is sufficiently large to permit the fuel to seep out as a result of the fuel expansion in the cannister when the cannister is fully filled, while small enough to preclude the fluid from gushing therethrough in the event that the cannister is inverted or otherwise knocked over.

An automatic snuffer is mounted on the tubular portion and is constructed in accordance with the teachings of my U.S. Pat. No. 3,885,905, whose disclosure is also incorporated by reference herein. The snuffer basically comprises a hollow member disposed on the tubular portion and loosely coupled thereto such that when the lamp is impacted suddenly or knocked over, a portion of the snuffer overlies the exposed wick portion to extinguish the flame.

While the lamp disclosed in my earlier patent is suitable for its intended purposes, the use of a metal cannister serving as the fuel reservoir leaves much to be desired from a standpoint of cost of manufacture. Moreover, the use of a metal cannister body renders the cannister susceptible to permanent physical deformation in the event that the cannister is impacted.

The use of plastics for various cannisters is gaining increasing acceptance in various applications, e.g., soft drink bottles, which had previously used metal or glass containers. One major advantage of plastic container is their inherently lower cost, particularly, those formed by blow molding techniques, coupled with the ability of plastic to withstand impact and recover from temporary deformation.

While the use of blow molded plastic containers is becoming more widespread, such containers have not been used for applications in which the container includes a mouth configured to receive a closure of the so called "one-inch aerosol opening" type. One major reason for the non-use of aerosol-type closures on plastic cannisters is the fact that the mouth of a blow molded container is not amenable to form a good fluid-tight seal with a metal closure.

The aerosol container industry has also been limited to the use of metal cannisters owing to the fact that such cannisters can be made fluid-tight with a metal closure.

The use of plastic containers for aerosol products is desirable for various reasons in addition to economy. For example, plastic containers do not present an explosion hazard if subjected to fire. In this regard, a plastic container having a pressurized product therein will melt and the contents escape without presenting an explosion hazard. In contradistinction, conventional aerosol cans, i.e., metal cannisters, exhibit the tendency to explode when subject to heat due to the pressure buildup within the cannister. Thus, the need presently exists within the aerosol industry for a plastic cannister having a metal closure which is secured to the cannister in a good fluid-tight seal.

OBJECTS OF THE INVENTION

Accordingly, it is a general object of the instant invention to provide a plastic container and a metal closure therefor which overcomes the disadvantages of the prior art.

It is a further object of the instant invention to provide a plastic container having a metal closure which can be permanently secured thereto in a good fluid-tight seal.

It is still a further object of the instant invention to provide a plastic container having a metal closure which is a simple in construction and low in cost.

It is still a further object of the instant invention to provide a disposable combustible fuel lamp assembly including a plastic cannister holding the fuel therein and a metal closure for said cannister.

It is a further object of the instant invention to provide a plastic cannister and metal closure therefor suitable for use as the container for aerosol-dispensed products.

It is still a further object of the instant invention to provide a method for sealing the mouth of a plastic container with a metal closure to form a good, fluid-tight seal.

SUMMARY OF THE INVENTION

These and other object of the instant invention are achieved by providing a container for holding a fluid therein and the method of making the container. The container comprises a hollow body formed of plastic and having a mouth and metal closure means secured to the mouth in a fluid-tight seal. The closure means includes cap means which is circular in profile and has a rolled lip extending about the periphery thereof, with the lip having a free edge and an underside surface. Gasket means are located on the underside surface of the lip. The mouth of the body is tubular and includes bead means extending about the periphery thereof contiguous with the free end of the mouth. The bead means includes a pair of tapered edge portions extending about the periphery thereof. The bead means is located within the rolled lip of the cap means, with the closure means' lip being bent around the bead means, whereupon the tapered edges of the bead means tightly engage the gasket means along respective lines to form a fluid-tight seal between the body and the closure means. In the method, the closure means is secured to the mouth of the bottle by disposing collet means over the closure lip and constricting the collet means to bend the lip around the bead means, whereupon the tapered edges of the bead means engage the gasket means along respective lines to form said fluid-tight seal.

Other objects and many of the attendant advantages of this invention will be readily appreciated as the same becomes better understood by reference to the following detailed description when considered in connection with the accompanying drawing wherein:

DESCRIPTION OF THE DRAWING

FIG. 1 is a side elevational view of a self-contained and replaceable fuel-burning lamp assembly constructed in accordance with the instant invention and suitable for use to form a decorative lamp;

FIG. 2 is an enlarged side elevational view, partially in section, of a mouth area of the cannister constructed in accordance with the instant invention;

FIG. 3 is an enlarged side elevational view, partially in section, showing a mouth portion of the cannister and a portion of the closure prior to its securement on said mouth;

FIG. 4 is an enlarged sectional view of the portion of the closure-mouth interface shown within the area identified as "FIG. 4" in FIG. 3;

FIG. 5 is an exploded perspective view of the portion of the closure means and collet means prior to its use in securing the closure means to the mouth of the cannister;

FIG. 6 is a side elevational view, similar to that of FIG. 3, but showing the collet means effecting the securement of the closure means to said cannister mouth; and FIG. 7 is an enlarged sectional view of the closure-mouth interface shown within the area identified as "FIG. 7" in FIG. 6.

DETAILED DESCRIPTION OF THE PREFERRED EMBODIMENT

Referring now to the various figures of the drawing wherein like reference characters refer to like parts, there is shown at 20 in FIG. 1 a self-contained, fuel-burning lamp assembly constructed in accordance with the instant invention. The lamp assembly 20 basically comprises a cannister 22 and a top assembly 24. The cannister is a hollow, plastic member containing a fluid fuel, e.g, mineral spirits, which is burned to effect lamp illumination. The details of the cannister will be described later. The top assembly 24 serves as the closure for the cannister and also forms the lamp's burner. The details of the top assembly will also be described later.

The cannister 22 is preferably formed by blow molding any suitable, impact resistant, lightweight plastic, which is compatible with the fuel to be stored therein. One such plastic is polyvinylchloride (PVC). The cannister basically comprises a cylindrical-shaped body having a circular sidewall 26, a bottom wall (not shown) and a top wall 28. Projecting upward from the center of the top wall is a tubular mouth 30.

The lamp assembly 20 of the instant invention may be disposed within a decorative lamp housing, like that disclosed in my aforementioned U.S. Pat. No. 4,025,290, to complete a decorative lamp or may be used alone to form a decorative lamp. In the latter case, it is preferred that the cannister 26 itself be decorative. To that end, the sidewall of the cannister can be decorated such as by the use of decorative surface features molded therein during the blow-molding process or by the use of decorative sleeves, e.g., preprinted heat shrinkable bands, etc., or other decorative components secured to the sidewall.

In the embodiment shown in FIG. 1, the lamp assembly is arranged for independent use, i.e., use without a decorative housing. Accordingly, an annular ledge 32 is located at the interface of the top wall 28 and the sidewall 22 of the cannister. Plural projections 34 extend radially outward from the ledge at equadistantly spaced locations around the periphery of the ledge. A decorative, transparent or transluscent sleeve or cover 36 is mounted on the cannister by slipping its lower end over the ledge whereupon the projections 34 frictionally engage the inner surface of the sleeve 36 at its lower end.

Referring now to FIG. 2, the details of the container's mouth 30 will be described. As can be seen, the mouth 30 is a tubular projection extending up from the top wall 28 at the center thereof. The free edge 38 of the mouth is in the form of a bead 40 extending around the periphery thereof and bulged out from the outer surface 42 of the mouth. As can be seen clearly in FIG. 4, a generally V-shaped recess 44 is provided in the bead and extends about the full periphery thereof. The V-shaped recess 44 includes a bottom surface 46 extending generally radially to the central longitudinal axis 48 of the cannister. The other surface of the recess, identified by the reference numeral 50, extends at approximately an 80° angle to the surface 46. The interface of the surface 46 with the outer surface of the bead 40 forms a corner 52 which extends about the periphery of the mouth in generally a radial direction with respect to axis 48. The interface of the surface 50 and the outer surface of the bead forms a second corner 54 which extends about the periphery of the bead and which is directed generally upward.

The corner 52 and 54 serve as means for effecting a fluid-tight seal between the top assembly 24 and the cannister.

As can be seen in FIGS. 1 and 3, the top assembly 24 basically comprises a hollow crown 56 including a projecting tubular portion 58 (FIG. 3) having an opening 60 at the top end thereof. A cap (not shown) constructed in accordance with the teachings of my aforenoted U.S. Pat. No. 3,885,905, is located on the top of the tubular portion 58. A wick 62 (only a portion of which is shown in FIG. 1) extends through openings in the cap with the wick extending down through the crown 56, and the mouth 30 of the cannister for immersion in the fuel (not shown) held within the cannister. The projecting portion of the wick 62 shown in FIG. 1 serves as the flame site for the lamp.

Automatic snuffer means, constructed in accordance with the teachings of my foregoing U.S. Pat. No. 3,885,905 is mounted on the crown 56. The snuffer 64 basically comprises a hollow member of generally conical shape having a base wall 66 and a sidewall 68. The base wall 66 includes a central opening through which the tubular portion 58 of the crown extends. The sidewall 68 projects generally inward from the periphery of the base wall. When the burner assembly is in its stable upright orientation like that shown in FIG. 1, the periphery of the opening (not shown) in the base wall 66 of the automatic snuffer abuts conical surface portions 70 of the crown 56 so that the snuffer is generally horizontal. In this position, the entire wick tip is exposed and uncovered to enable the combustion of fuel to occur uninterrupted at the wick tip to produce and maintain a flame thereat. The conical surface 70 serves as a pivot surface about which the snuffer rotates eccentrically when the burner assembly is suddenly impacted. In such an occurrence, the peripheral portion of the sidewall 68 overlies the exposed wick tip to extinguish the flame. If the lamp is overturned, the loose coupling between the snuffer 68 and the crown 56 enables the snuffer to pivot about the tubular portion 48, whereupon the snuffer sidewall 68 overlies the wick tip to extinguish the flame.

The crown 56 is circular in profile when viewed from above and includes a peripheral lip 72 in the form of a U-shaped or downwardly rolled flange. The lip 72 includes an annular recess in the underside surface 74 for receipt of the beaded free edge 38 of the cannister mouth 30 as shown in FIG. 4.

As can be seen in FIG. 4, a gasket 76 is located on the inner surface 74 of the lip 72. The gasket is in the form of a film of a somewhat resilient material, such as water-soluble vinyl, which has been coated onto the surface 74.

The securement of the crown 56 to the mouth 30 of the cannister is accomplished by bending the flanged lip 72 around the bottom of the beaded portion of the mouth by use of a collet 80. The collet is shown clearly in FIGS. 5 and 6.

In FIG. 5, the collet is shown located above the crown 56 prior to the bending or crimping of the flange 72 about the beaded portion of the cannister mouth. The collet is a generally tube-shaped member having a plurality of elongated fingers 82 spaced apart from one another by respective slots 84. Each of the fingers 82 merges into a solid sleeve portion 86 at the top of the collet. The sleeve portion 86 is internally threaded for connection to suitable machinery (not shown). The free end of each of the fingers flares outward at 88 at the lower end thereof, with the inner surface of each finger at end 88 forming a flanged projection 90 (FIG. 6) having a curved inner surface for bending the crown lip 72 into engagement with the beaded mouth of the cannister.

The collet 88 is arranged to be reciprocated within a tubular member (not shown) so that the flared surfaces 88 of the collet act as camming surfaces bending each finger radially inward, whereupon the radially extending flanged projections 90 engage the free edge of the lip 72 to crimp the lip around the beaded portion of the cannister mouth. The crimping action causes the corners 52 and 54 of the bead to dig into the gasket 76 as shown in FIG. 7. This digging action results in the formation of a good fluid-tight seal between the beaded portion and the lip of the crown. Once the securement is completed, the collet is slid downward relative to the tubular member (not shown) so that the collet fingers 82 spring back to the position shown in FIG. 5, thereby releasing the collet from the completed lamp assembly.

As will be appreciated by those skilled in the art, the two corners 52 and 54 create a double circumferential seal between the crown member and the cannister, with each seal extending for the full extent of the periphery of the cannister mouth. The double seal thus insures that the fuel (which typically has a low surface tension) is prevented from leaking out of the cannister at the interface of the cannister and crown. Moreover, the double seal renders the subject construction suitable for use in container applications heretofore reserved for all-metal constructions, e.g., aerosol spray cans.

As will be appreciated from the foregoing, the lamp assembly of the subject invention is simple in construction and can be manufactured at relatively low cost. Moreover, by virtue of the use of a plastic cannister, impact resistance and resistance to deformation of the device is enhanced without any danger of fuel leakage. Furthermore, the plastic-metal seal produced by the subject invention renders the invention suitable for use in numerous packaging applications, such as aerosol spray cans, pressurized vessels, etc.

Without further elaboration, the foregoing will so fully illustrate our invention that others may, by applying current or future knowledge, readily adapt the same for use under various conditions of service.

I claim:

1. A container for holding a fluid therein and comprising a hollow body formed of a plastic material and having a mouth and metal closure means secured to said mouth in a fluid-tight seal, said closure means comprising a cap having a circular profile and a rolled lip extending about the periphery thereof and terminating in a free edge, said lip having an underside surface, gasket means located on said underside surface, said mouth being tubular and having a longitudinal axis, said mouth including bead means extending about the periphery of said mouth about said axis and contiguous with the free end of said mouth, said bead means including an arcuate outer surface including an annular recess extending about the periphery of said mouth and forming a pair of generally pointed corners adjacent said arcuate outer surface, each of said corners being directed outwardly away from the longitudinal axis of said container and spaced from each other in the longitudinal direction, said bead means being located within said rolled lip, with said lip being bent tightly thereabout and with the free edge disposed under said bead means, whereupon said corners tightly engage and dig into said gasket means along longitudinally spaced lines to form a fluid-tight seal between said body and said cap.

2. The container of claim 1 wherein said annular recess comprises a pair of planar sides disposed at an angle to each other and wherein one of said corners extends in a direction generally radially to said axis.

3. The container of claim 2 wherein the other of said corners extends at an acute angle to said one corner.

4. The container of claim 3 wherein said angle is approximately 80°.

5. The container of claim 1 wherein said peripheral recess is generally V-shaped.

6. The container of claim 1 wherein said plastic body is blow molded.

7. The container of claim 1 wherein said gasket means comprises a coating on the underside surface of said lip.

8. The container of claim 7 wherein said gasket comprises a water-soluble vinyl.

9. The container of claim 8 wherein said plastic is a tough, impact resistant, yet somewhat resilient plastic.

10. The container of claim 9 wherein said plastic comprises polyvinylchloride.

11. The container of claim 1 wherein said container comprises a disposable, combustion lamp and wherein said closure means includes burner means.

12. The lamp of claim 11 wherein said fluid comprises mineral spirits.

13. The method of sealing the mouth of a plastic container with a metal closure, said container having a tubular mouth having a longitudinal axis and including bead means extending about the periphery of the mouth contiguous with the free end thereof, said bead means including an arcuate outer surface including an annular recess extending about the periphery of said mouth and forming a pair of generally pointed corners extending about the periphery of said bead means adjacent said arcuate outer surface, each of said corners being directed outwardly away from the longitudinal axis of said container and spaced from each other in the longitudinal direction, said closure means including cap means, circular in profile, and having a roller lip extending about the periphery thereof and terminating in a free edge, said lip having an underside surface upon which gasket means is disposed, said method comprising the steps of disposing said cap means on said mouth and with said bead means located within said lip, disposing lip deforming means over said lip, constricting said lip deforming means in a radial direction to deform said lip around said bead means and causing both of said corners of said bead means to engage and dig into said gasket means along respective longitudinally spaced lines to form a fluid-tight seal between said cap means and said container.

14. The method of claim 13 wherein said lip deforming means comprises collet means in the form of a radially compressable tubular member.

15. The method of claim 14 wherein said collet means includes a peripheral flange for bending said lip around said bead means.

16. The method of claim 15 wherein said collet includes a plurality of longitudinally extending spaced fingers, each terminating in a flanged portion.

17. The method of claim 13 wherein said container is filled with a fluid prior to the sealing of said container with said closure means.

* * * * *